US009728194B2

(12) United States Patent
Kjoerling et al.

(10) Patent No.: US 9,728,194 B2
(45) Date of Patent: Aug. 8, 2017

(54) AUDIO PROCESSING

(71) Applicant: DOLBY INTERNATIONAL AB, Amsterdam (NL)

(72) Inventors: Kristofer Kjoerling, Stockholm (SE); Heiko Purnhagen, Stockholm (SE); Karl J. Roeden, Stockholm (SE); Leif Sehlstrom, Stockholm (SE); Lars Villemoes, Stockholm (SE)

(73) Assignee: Dolby International AB, Amsterdam (NL)

( * ) Notice: Subject to any disclaimer, the term of this patent is extended or adjusted under 35 U.S.C. 154(b) by 162 days.

(21) Appl. No.: 14/377,260

(22) PCT Filed: Feb. 22, 2013

(86) PCT No.: PCT/EP2013/053610

§ 371 (c)(1),
(2) Date: Aug. 7, 2014

(87) PCT Pub. No.: WO2013/124446

PCT Pub. Date: Aug. 29, 2013

(65) Prior Publication Data

US 2016/0019899 A1 Jan. 21, 2016

Related U.S. Application Data

(60) Provisional application No. 61/603,001, filed on Feb. 24, 2012, provisional application No. 61/645,809, filed on May 11, 2012.

(51) Int. Cl.
*H04R 5/00* (2006.01)
*G10L 19/008* (2013.01)

(52) U.S. Cl.
CPC ..... *G10L 19/008* (2013.01); *H04S 2420/03* (2013.01)

(58) Field of Classification Search
CPC .... H04S 2400/03; H04S 2420/03; H04S 3/02; H04S 5/00; H04S 5/02; H04S 5/005; G10L 19/008
(Continued)

(56) References Cited

U.S. PATENT DOCUMENTS 6,282,631 B1 * 8/2001 Arbel ..... G06F 9/30101 712/26
6,768,979 B1 * 7/2004 Menendez-Pidal ..... F16J 15/43 704/226
(Continued)

FOREIGN PATENT DOCUMENTS

CN 1278996 1/2001
EP 1 410 687 4/2004
(Continued)

OTHER PUBLICATIONS

Engdegard, J. et al "Technical Provisions for Low-Delay SAOC Multi-Channel Rendering" MPEG Meeting, Jun. 29-Jul. 3, 2009, London, Motion Picture Expert Group or ISO/IEC JTC1/SC29/WG11, No. M16656, Jun. 25, 2009.
(Continued)

*Primary Examiner* — William A Jerez Lora

(57) ABSTRACT

An audio processing system (100) for spatial synthesis comprises an upmix stage (110) receiving a decoded m-channel downmix signal (X) and outputting, based thereon, an n-channel upmix signal (Y), wherein 2≤m<n. The upmix stage comprises a downmix modifying processor (120), which receives the m-channel downmix signal and outputting a modified downmix signal ($d_1$, $d_2$) obtained by cross mixing and non-linear processing of the downmix signal, and further comprises a first mixing matrix (130) receiving the downmix signal and the modified downmix signal, forming an n-channel linear combination of the downmix signal channels and modified downmix signal
(Continued)

channels only and outputting this as the n-channel upmix signal. In an embodiment, the first mixing matrix accepts one or more mixing parameters (g, $\alpha_1$, . . . ) controlling at least one gain in the linear combination performed by the first mixing matrix. The gains are polynomials of degree ≤2.

18 Claims, 2 Drawing Sheets

(58) Field of Classification Search
USPC ..... 381/18, 19–23, 119
See application file for complete search history.

(56) References Cited

U.S. PATENT DOCUMENTS

2006/0239473 A1* 10/2006 Kjorling ..... H04S 5/005 381/98
2007/0110254 A1* 5/2007 Christoph ..... H04M 3/56 381/66
2009/0144063 A1* 6/2009 Beack ..... G10L 19/008 704/500
2009/0240503 A1* 9/2009 Miyasaka ..... G10L 19/008 704/500
2013/0051207 A1* 2/2013 Yoshinari ..... H04S 7/30 381/119

FOREIGN PATENT DOCUMENTS

| | | |
|---|---|---|
| EP | 1 616 461 | 1/2006 |
| JP | 2006-203906 | 8/2006 |
| JP | 2006-325162 | 11/2006 |
| JP | 2008-514098 | 5/2008 |
| JP | 5133401 | 7/2010 |
| JP | 2011-528129 | 11/2011 |
| WO | 2008/131903 | 11/2008 |
| WO | 2009/131066 | 10/2009 |

OTHER PUBLICATIONS

ITU-R Radiocommunication Sector of ITU, Recommendation ITU-R, BS.775-3 "Multichannel Stereophonic Sound System with and without Accompanying Picture" Aug. 2012.

* cited by examiner

AUDIO PROCESSING

CROSS-REFERENCE TO RELATED APPLICATIONS

This application claims priority to U.S. Provisional Patent Application Nos. 61/603,001 filed 24 Feb. 2012 and 61/645,809 filed 11 May 2012, which are hereby incorporated by reference in its entirety.

TECHNICAL FIELD

The invention disclosed herein generally relates to multichannel audio coding and more precisely to techniques for parametric multichannel audio encoding and decoding.

BACKGROUND

Parametric stereo and multi-channel coding methods are known to be scalable and efficient in terms of listening quality, which makes them particularly attractive in low bitrate applications. Parametric coding methods typically offer excellent coding efficiency but may sometimes involve a large amount of computations or high structural complexity when implemented (intermediate buffers etc.). See EP 1 410 687 B1 for an example of such methods.

Existing stereo coding methods may be improved from the point of view of their bandwidth efficiency, computational efficiency and/or robustness. Robustness against defects in the downmix signal is particularly relevant in applications relying on a core coder that may temporarily distort the signal. In some prior art systems, however, an error in the downmix signal may propagate and multiply. A coding method intended for a large range of devices, in which multi-functional portable consumer devices may have the most limited processing power, should also be computationally lean so as not to demand an unreasonable share of the available resources in a given device, neither regarding momentary processing capacity nor total energy use over a battery discharge cycle. An attractive coding method may also enable at least one simple and efficient implementation in hardware. Making decisions on how such a coding method is to spend available computational, storage and bandwidth resources where they contribute most efficiently to the perceived listening quality is a non-trivial task, which may involve time-consuming listening tests.

BRIEF DESCRIPTION OF THE DRAWINGS

Embodiments of the invention will now be described with reference to the accompanying drawings, on which.

All the figures are schematic and generally only show parts which are necessary in order to elucidate the invention, whereas other parts may be omitted or merely suggested. Unless otherwise indicated, like reference numerals refer to like parts in different figures.

DESCRIPTION OF EXAMPLE EMBODIMENTS

I. Overview

Figure 1:
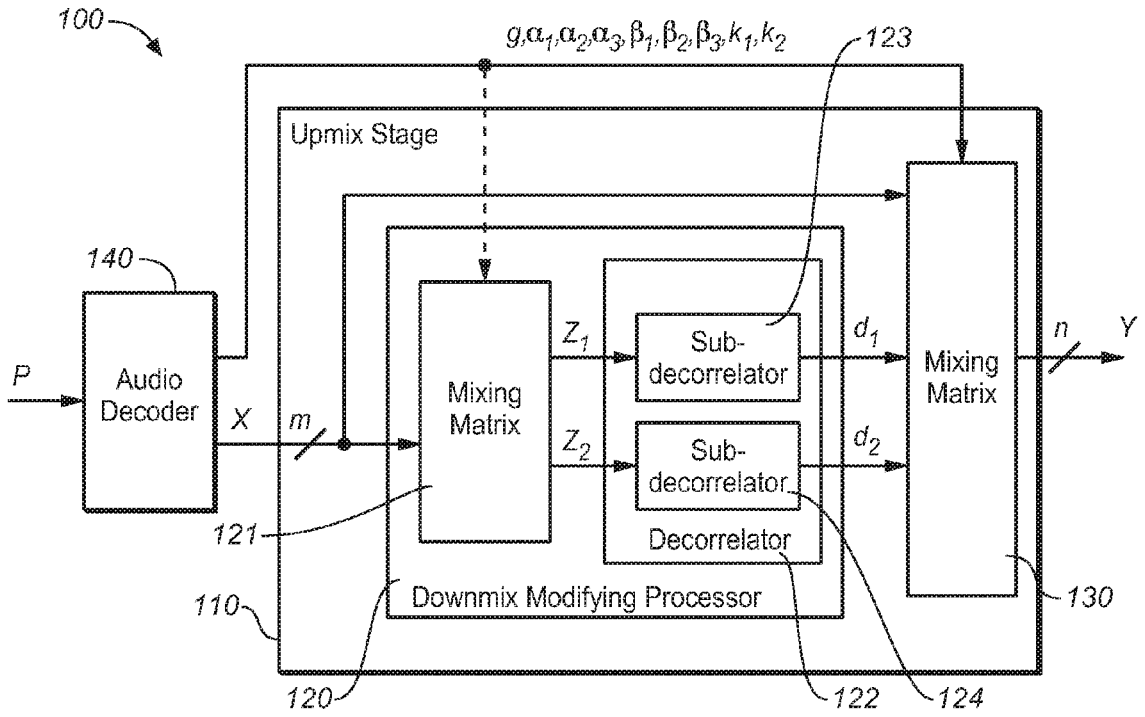
FIG. 1 is a generalized block diagram of an audio processing system for performing spatial synthesis.

An example embodiment of the present invention proposes methods and devices enabling analysis and synthesis of parametrically coded multi-channel audio. An example embodiment of the invention provides a spatial synthesis method, a spatial analysis method as well as devices and computer-program products for performing the methods, with the features set forth in the independent claims.

A first example embodiment of the invention provides an audio processing system for performing spatial synthesis. The system comprises an upmix stage adapted to receive a decoded m-channel downmix signal X and to output, based thereon, an n-channel upmix signal Y, wherein $2 \leq m < n$. The upmix stage comprises:

- a downmix modifying processor receiving the m-channel downmix signal and outputting a modified downmix signal D obtained by cross mixing and non-linear processing of the downmix signal; and
- a first mixing matrix receiving the downmix signal and the modified downmix signal, forming an n-channel linear combination of the downmix signal channels and modified downmix signal channels only and outputting this as the n-channel upmix signal.

According to the invention, no other signal than the downmix signal and the modified downmix signal contributes to the upmix signal. Instead of having cascaded mixing matrices, possibly with intermediate non-linear operations (e.g., decorrelation-related processing), the mixing matrix operates directly on the downmix signal. This structure of the system, as well as the parameterization that will be described in what follows, allows for the provision of a parallel pre-defined downmix in an encoder. For instance, the downmix signal is not necessarily obtained through a cascaded (and possibly treestructured) parameter extraction, as is typically the case where frame-wise signal-adaptive downmixing is used. Instead, according to embodiments of the invention, downmix and parameter extraction may be executed as parallel independent processes that need not exchange any information and/or need not be synchronized. Further, compared to prior art parameterization schemes in which an output channel is deduced from an intermediate estimated channel, the parameterization to be described below is more robust against defects in the downmix signal. As another advantage, this parameterization may be implemented with inexpensive hardware (e.g., with a limited amount of buffer space for intermediate values).

A second example embodiment provides an audio processing system for performing spatial analysis and adapted to cooperate with the first example embodiment, e.g., by broadcasting, streaming, transporting or storing encoded audio data to be decoded by the synthesis system. The system includes a downmix stage and a parameter extractor. According to the invention, the downmix stage and the parameter extractor operate independently. For example, the downmix stage may operate on time-domain representations of the audio signals, even though the parameter extractor produces frequency-variant mixing parameters. This is possible because the downmix stage performs downmix operations of a predefined type, which is known by or communicated to the parameter extractor. Because the downmix stage processes a signal in the time domain, it may operate substantially without algorithmic delay. This is particularly so if the downmix stage does not apply a condition requiring energy conservation or the like, which may otherwise necessitate a block-oriented implementation, in which the downmix signal is produced as segments of non-zero length, on which the condition is enforced. In an embodiment applying time-domain downmixing, however, any delay between the (n-channel) input and (m-channel) output may be reduced substantially to zero by allocating sufficient processing resources.

In an example embodiment, the downmix signal is a 2-channel stereo signal and the upmix signal is a 5.1-channel signal (n=6).

In an example embodiment, all gains applied in order to obtain spatially left and right channels in the upmix signal (these channels may be regarded as a set of channels in the upmix signal; it may be a proper subset of the channels in the upmix signal) are polynomials in one or more of the mixing parameters, wherein the degree of each polynomial is less than or equal to 2. This provides for inexpensive computation of the mixing matrix elements on the basis of the mixing parameters. The improvement in this respect is particularly notable in comparison with parameterization schemes in which some matrix elements cannot be computed exactly in a finite number of operations, e.g., matrix elements being trigonometric functions of a mixing parameter. Another advantage of using gains which are low-degree polynomials for this set of channels is that the gains will contain terms that are products of at most two mixing parameters each. This implies that the risk of error propagation is lower than if the gains had contained terms being products of three or more mixing parameters. It also implies that the risk of having terms where three or more erroneous mixing parameters cooperate constructively, as is the case for example in a product of three mixing parameters all of which are greater than their exact values. Instead, according to the present example embodiment, there is an increased likelihood that differently signed errors cancel. In a specific variation to this example embodiment, any gains applied in order to obtain the channels in the upmix signal are polynomials of degree at most 2.

In an example embodiment, the gains applied to channels in the downmix signal are encoded in a different way than the gains applied to channels in the modified downmix signal. In this example embodiment, the gains applied to the channels in the downmix signal are polynomials in the mixing parameters of degree 2, and the gains applied to the channels in the modified downmix signal are polynomials in the mixing parameters of degree 0 or 1. By this approach, the gains applied to the modified downmix signal are not as controllable, but will also consume a smaller amount of bandwidth or storage space, as the case may be. Conversely, the contribution from those channels in which defects (e.g., errors, artifacts) may be most audible is controlled by gains containing terms that are products of two mixing parameters in addition to terms with single mixing parameters. This allows for fine-grained controllability and advanced statistical modeling. Hence, bandwidth is used more efficiently.

In a further development of the preceding example embodiment, the mixing parameters forming part of the gains applied to the channels in the modified downmix signal are uniformly quantized.

In an example embodiment, there is a direct relationship between spatially corresponding channels in the downmix signal and in the upmix signal. Examples of spatially corresponding channels may be: (1) a left channel in the downmix signal and all left channels (regular left, front left, left of center, left height, left surround, direct left surround, rear left surround, left wide) in the upmix; (2) a center channel in the downmix signal and a center channel in the upmix. The direct relationship may entail that a variation in a channel in the downmix signal has an independently controllable impact on the spatially corresponding channel(s) in the upmix signal. More precisely, a contribution from a channel in the downmix signal to a spatially corresponding channel in the upmix signal is individually controllable by varying an independent mixing parameter g, as per the following exemplifying equation:

$$\begin{bmatrix} l_1 \\ \vdots \\ l_p \\ r_1 \\ \vdots \\ r_p \\ * \\ \vdots \end{bmatrix} = \frac{g}{2} \begin{bmatrix} 1 & 0 \\ \vdots & \vdots \\ 1 & 0 \\ 0 & 1 \\ \vdots & \vdots \\ 0 & 1 \\ 0 & 0 \\ \vdots & \vdots \end{bmatrix} \begin{bmatrix} l_0 \\ r_0 \end{bmatrix} + f(X, D; \alpha_1, \alpha_2, \alpha_3, \beta_1, \beta_2, \beta_3, k_1, k_2),$$

where the left-hand side represents the upmix signal, which in this example contains p≥1 left-type and p≥1 right-type channels and an arbitrary number of further channels denoted by "★", which neither have left-type or right-type character. The last factor in the first term on the right-hand side represents the downmix signal, and f is an n-dimensional linear combination of the channels in the downmix signal X and modified downmix signal D (wherein the function f may additionally depend on further mixing parameters, possibly including parameter g itself). Similarly to the effect of the preceding example embodiment, this particular aspect of the parameterization represents a conscious way of spending available bandwidth, with the purpose of achieving that those aspects of the upmix signal which the inventors have found being most audible are associated a high degree of controllability; conversely, greater (potential) inaccuracies are accepted where they have turned out to be less perceptible. In a further development of this example embodiment, the channels for which there are spatial correspondences to the channels in the downmix signals receive contributions from the downmix signal X and the modified downmix signal D, in accordance with gains which are however controllable by uniformly quantized parameters only. Further preferably, the mixing parameter g appearing in the above equation is non-uniformly quantized. Instead, a refined resolution is used in order to reduce the average quantization error. For instance, the mixing parameter g may be quantized with respect to logarithmically or exponentially spaced steps. The upmix signal may comprise further signals receiving contributions from the downmix signal X and/or the modified downmix signal D. These further signals, such as low-frequency effects or center channels, may be spatially unrelated to the signals in the downmix.

In an example embodiment, one of the mixing parameters encoded in the bitstream controls two numbers $k_1$, $k_2$, which will be referred to as gain parameters. Further, one or more gains in the linear combination performed by the first matrix depend linearly on one of these gain parameters, i.e., the magnitude of each gain is proportional to one of the gain parameters. Preferably the concerned one or more gains are applied to obtain channels which are not laterally characterized, e.g., center, low-frequency effect, height etc. rather than left-type or right-type channels. Because the two gain parameters are not controllable independently, it is sufficient to encode them by one mixing parameter, which entails a bandwidth saving. The inventors have realized that this bandwidth saving does not have adverse effects on the perceived sound quality.

In an example embodiment, the mixing parameters are frequency-dependent. More precisely, the audio signals processed by the system share a common time/frequency tiling, and the mixing parameters share a common time/frequency tiling. With respect to frequency, the signals and the parameters are divided into frequency subbands. The subbands of an audio signal represent the spectral content in these subbands, whereas the subbands of a mixing parameter control the gains to be applied to the frequency bands of the audio signals in the linear combination performed by the first mixing matrix. For a given time frame, all signals have one common subband configuration, and all mixing parameters have one common subband configuration. The subband configuration of the signals may be finer than the subband configuration of the mixing parameters, wherein for instance one mixing parameter subband controls the gain of two or more signal subbands. There may be a well-defined mapping between the two subband configurations. The subband configurations may be uniform, insofar as one width applies to all bands, or non-uniform, wherein a finer frequency resolution may be chosen in psychoacoustically more sensitive frequency ranges.

In an example embodiment including frequency-dependent mixing parameters as described above, there is at least one mixing parameter for which all frequency subbands are quantized with respect to a uniform resolution (e.g., a discrete value scale, a discrete equidistant value scale or a look-up table associated with a discrete index). This simplifies the operation of populating the first mixing matrix on the basis of the mixing parameters. In particular, the uniform resolution may be common to all frequency subbands of this mixing parameter. Generally speaking, the selection of an encoding scheme is influential to the spectral efficiency (e.g., the ratio of the bitrate to the required transmitted bandwidth) and other figures of merit of a data transport format.

In an example embodiment, the system is configured to generate the upmix signal in a qualitatively uniform fashion for all frequency subbands. In particular, the same parameterization of the first mixing matrix is used for all frequency subbands. The inventors have realized that the experienced output quality produced by the system is competitive even though the system does not distinguish between different frequency ranges (i.e., sets of subbands) as regards their qualitative treatment. Nevertheless, there is a quantitative variation between frequency subbands insofar as the mixing parameter values may vary.

In an example embodiment, the audio processing system, or at least the downmix modifying processor and the first mixing matrix, operate on partially complex frequency-domain representations of the downmix and upmix signals. While critical sampling (real data only) may be used in psychoacoustically less sensitive frequency ranges to save bandwidth, an overcritical representation (full complex data) is used elsewhere, so as to prevent audible aliasing-related artifacts. For this purpose, the audio processing system may include a real-to-complex conversion stage.

In an example embodiment, the downmix modifying processor comprises a second mixing matrix producing an intermediate signal Z and a decorrelator. The decorrelator may be an infinite impulse response filter or an arrangement of connected filters of this type. The decorrelator includes an artifact attenuator, which is configured to detect sound endings in the intermediate signal and to attenuate, based on the detected locations of the sound endings, undesirable artifacts in the decorrelated signal D. In particular, if the decorrelator includes a reverberation unit, unwanted reverb tails can be removed or made inaudible in this manner. Further details relating to artifact attenuators may be found, e.g., in EP 1 410 687 B1, par. 0016, and EP 1 616 461 B1, par. 0051. Because the downmix modifying processor performs a non-linear operation, the first and second matrices cannot be represented as a single matrix with elements that are constants with respect to the signals themselves.

In an example embodiment of the invention as an audio processing system for performing spatial analysis, the downmix stage applies downmix gains as provided in recommendation ITU-R BS.775.

In an example embodiment, the invention provides a data structure for storage or transmission of an audio signal, the structure including an m-channel downmix signal X and one or more mixing parameters $\alpha_1$, $\alpha_2$, $\alpha_3$, $\beta_1$, $\beta_2$, $\beta_3$, g, $k_1$, $k_2$ and being susceptible of decoding by forming an n-channel linear combination of the downmix signal channels and modified downmix signal channels only and by outputting this as an n-channel upmix signal, wherein $2 \leq m < n$ and wherein the modified downmix signal is obtained by cross mixing and non-linear processing of the downmix signal and said one or more mixing parameters control at least one gain in the linear combination. In particular, the invention provides a computer-readable medium storing information structured by the above data structure.

The dependent claims define further example embodiments of the invention. It is noted that the invention relates to all combinations of features, even if these are recited in different claims.

II. Example Embodiments

FIG. 1 illustrates in block-diagram form an example embodiment of the invention as an audio processing system 100. From a bitstream P, an audio decoder 140 extracts a downmix signal $X=[l_0\ r_0]^T$ and mixing parameters $\alpha_1$, $\alpha_2$, $\alpha_3$, $\beta_1$, $\beta_2$, $\beta_3$, g, $k_1$, $k_2$. The mixing parameters are included in quantized form in respective mixing parameter data fields in the bitstream P. In some instances of the present disclosure, it has been indicated explicitly that some connection lines are adapted to transmit multi-channel signals, wherein these lines have been provided with a cross line adjacent to the respective number of channels. In the system shown in FIG. 1, the downmix signal X comprises 2 channels, and an upmix signal Y to be defined below comprises 6 channels, hence m=2 and n=6. An upmix stage 110, the action of which depends parametrically on the mixing parameters, receives the downmix signal. A downmix modifying processor 120 modifies the downmix signal by non-linear processing and by forming a linear combination of the downmix channels, so as to obtain a modified downmix signal $D=[d_1\ d_2]^T$. A first mixing matrix 130 receives the downmix signal X and the modified downmix signal D and outputs an upmix signal $Y=[l_f\ l_s\ r_f\ r_s\ c\ lfe]^T$ by forming the following linear combination:

$$\begin{bmatrix} l_f \\ l_s \\ r_f \\ r_s \\ c \\ lfe \end{bmatrix} = \begin{bmatrix} (g-(\alpha_3+\beta_3))(1+\alpha_1)/2 & -(\alpha_3-\beta_3)(1+\alpha_1)/2 & \beta_1/2 & 0 \\ (g-(\alpha_3+\beta_3))(1-\alpha_1)/2 & -(\alpha_3-\beta_3)(1-\alpha_1)/2 & -\beta_1/2 & 0 \\ -(\alpha_3+\beta_3)(1+\alpha_2)/2 & (g-(\alpha_3-\beta_3))(1+\alpha_2)/2 & 0 & \beta_2/2 \\ -(\alpha_3+\beta_3)(1-\alpha_2)/2 & (g-(\alpha_3-\beta_3))(1-\alpha_2)/2 & 0 & -\beta_2/2 \\ (\alpha_3+\beta_3)k_1 & (\alpha_3-\beta_3)k_1 & 0 & 0 \\ (\alpha_3+\beta_3)k_2 & (\alpha_3-\beta_3)k_2 & 0 & 0 \end{bmatrix} \cdot \begin{bmatrix} l_0 \\ r_0 \\ d_1 \\ d_2 \end{bmatrix}$$

In the above linear combination, the mixing parameter $\alpha_3$ controls the contribution of a mid-type signal (proportional to $l_0+r_0$) formed from the downmix signal to all channels in the upmix signal. The mixing parameter $\beta_3$ controls the contribution of a side-type signal (proportional to $l_0-r_0$) to all channels in the upmix signal. Hence, in a use case, it may be reasonably expected that the mixing parameters $\alpha_3$ and $\beta_3$ will have different statistical properties, which enables more efficient coding. (Considering as a comparison a reference parameterization where independent mixing parameters $\alpha'$, $\beta'$ control respective left-channel and a right-channel contribution from the downmix signal to the spatially left and right channels in the upmix signal, it is noted that the statistical observables of such mixing parameters $\alpha'$, $\beta'$ may not differ notably.)

Returning to the linear combination shown in the above equation, it is noted, further, that the gain parameters $k_1$, $k_2$ may be dependent on a common single mixing parameter in the bitstream P.

As noted previously, the contributions from the modified downmix signal to the spatially left and right channels in the upmix signal are controlled separately by parameters Pi (first modified channel's contribution to left channels) and $\beta_2$ (second modified channel's contribution to right channels). Further, the contribution from each channel in the downmix signal to its spatially corresponding channels in the upmix signal is individually controllable by varying the independent mixing parameter g. Preferably, g is quantized non-uniformly so as to avoid large quantization errors.

Figure 2:
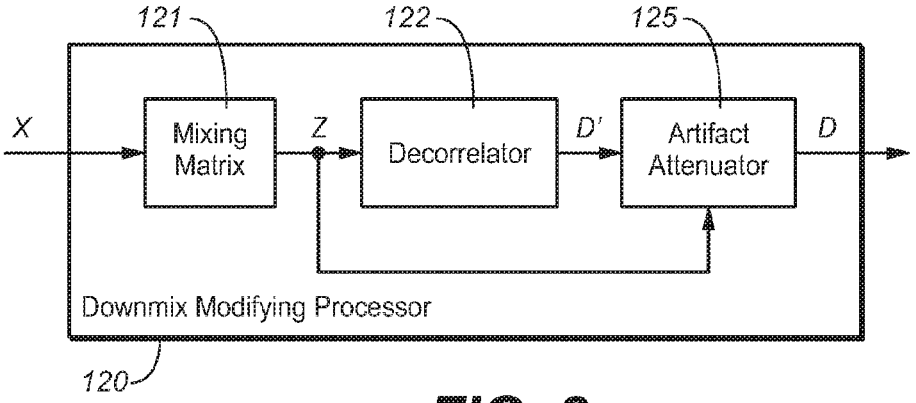
FIG. 2 shows a detail of the system in FIG. 1.

Referring now additionally to FIG. 2, the downmix modifying processor 120 performs, in a second mixing matrix 121, the following linear combination (which is a cross mix) of the downmix channels:

$$\begin{bmatrix} z_1 \\ z_2 \end{bmatrix} = \begin{bmatrix} g-(\alpha_3+\beta_3) & -(\alpha_3-\beta_3) \\ -(\alpha_3+\beta_3) & g-(\alpha_3-\beta_3) \end{bmatrix} \cdot \begin{bmatrix} l_0 \\ r_0 \end{bmatrix}$$

Clearly, the gains populating the second mixing matrix depend parametrically on some of the mixing parameters encoded in the bitstream P. The processing carried out by the second mixing matrix 121 results in an intermediate signal $Z=(z_1, z_2)$, which is supplied to a decorrelator 122. FIG. 1 shows an embodiment in which the decorrelator 122 comprises two sub-decorrelators 123, 124, which may be identically configured (i.e., providing identical outputs in response to identical outputs) or differently configured. As an alternative to this, FIG. 2 shows an embodiment in which all decorrelation-related operations are carried out by one unit 122, which outputs a preliminary modified downmix signal D'. The downmix modifying processor 120 in FIG. 2 further includes an artifact attenuator 125. In an example embodiment, as outlined above, the artifact attenuator 125 is configured to detect sound endings in the intermediate signal Z and to take corrective action by attenuating, based on the detected locations of the sound endings, undesirable artifacts in this signal. This attenuation produces the modified downmix signal D, which is output from the downmix modifying processor 120.

Figure 3:
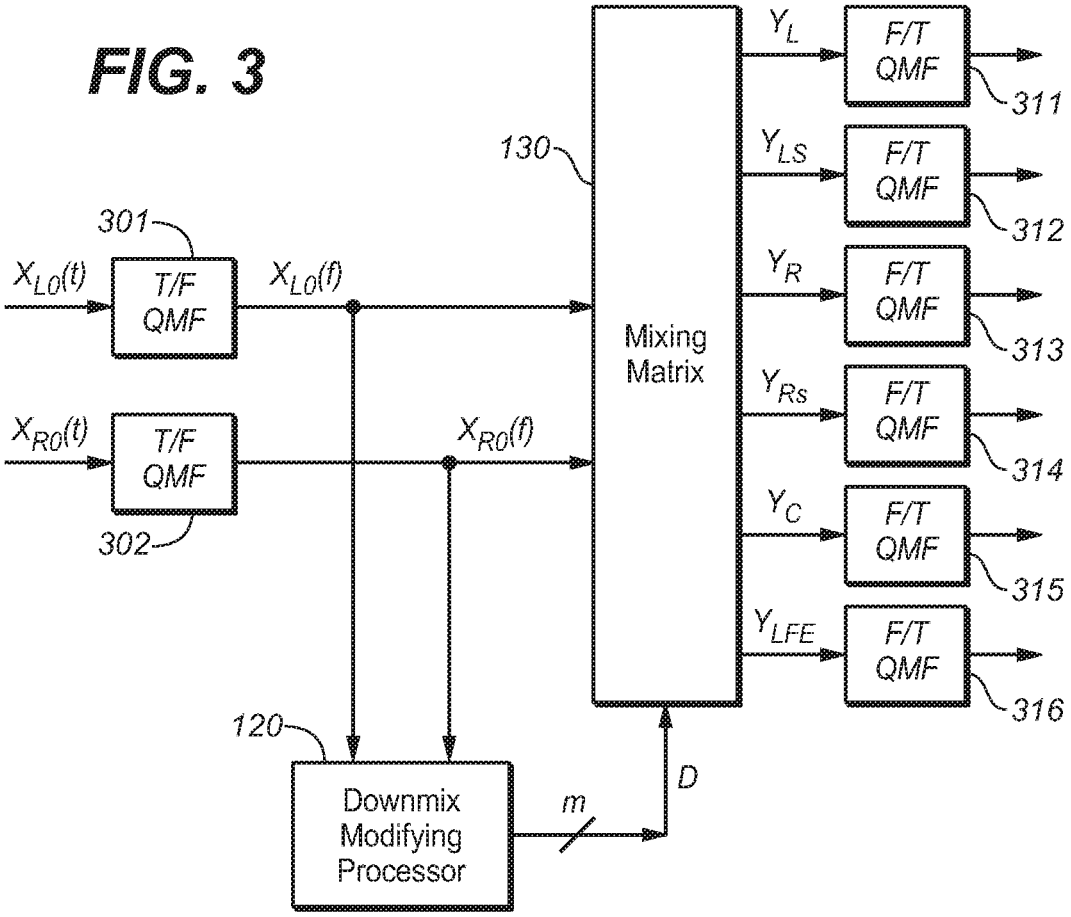
FIG. 3 shows, similarly to FIG. 1, an audio processing system for performing spatial synthesis.

FIG. 3 shows a first mixing matrix 130 of a similar type as the one shown in FIG. 1 and its associated transform stages 301, 302 and inverse transform stages 311, 312, 313, 314, 315, 316. Hence, the signals located upstream of the transform stages 301, 302 are representations in the time domain, as are the signals located downstream of the inverse transform stages 311, 312, 313, 314, 315, 316. The other signals are frequency-domain representations. The time-dependency of the other signals may for instance be expressed as discrete values or blocks of values relating to time blocks into which the signal is segmented. It is noted that FIG. 3 uses alternative notation in comparison with the matrix equations above; one may for instance have the correspondences $X_{L0}$~$l_0$, $X_{R0}$~$r_0$, $Y_L$~$l_f$, $Y_{Ls}$~$l_s$ and so forth. Further, the notation in FIG. 3 emphasizes the distinction between a time-domain representation $X_{L0}(t)$ of a signal and the frequency-domain representation $X_{L0}(f)$ of the same signal. It is understood that the frequency-domain representation is segmented into time frames; hence, it is a function both of a time and a frequency variable.

Figure 4:
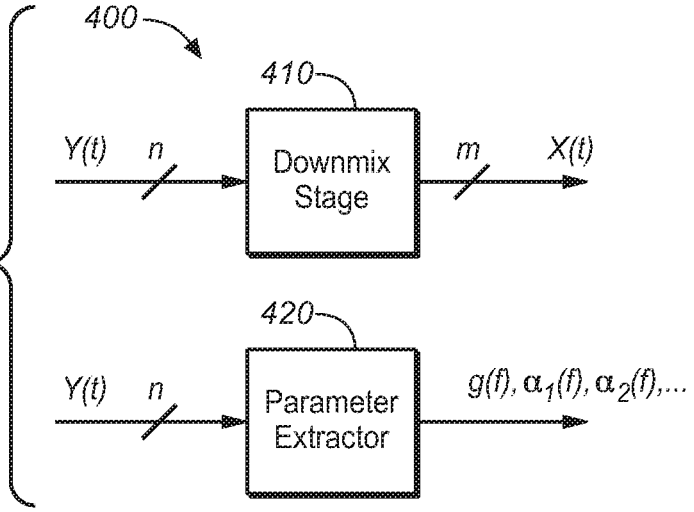
FIG. 4 shows an audio processing system for performing spatial analysis.

FIG. 4 shows an audio processing system 400 for generating the downmix signal X and the parameters controlling the gains applied by the upmix stage 110. This audio processing system 400 is typically located on an encoder side, e.g., in broadcasting or recording equipment, whereas the system 100 shown in FIG. 1 is typically to be deployed on a decoder side, e.g., in playback equipment. A downmix stage 410 produces an m-channel signal X on the basis of an n-channel signal Y. Preferably, the downmix stage 410 operates on time-domain representations of these signals. A parameter extractor 420 produces values of the mixing parameters $\alpha_1$, $\alpha_2$, $\alpha_3$, $\beta_1$, $\beta_2$, $\beta_3$, g, $k_1$, $k_2$ by analyzing the n-channel signal Y and taking into account the quantitative and qualitative properties of the downmix stage. The mixing parameters are vectors of frequency-block values, as the notation in FIG. 4 suggests, and are further segmented into time blocks. It is believed that those skilled in the art will be able to apply their common general knowledge and publicly available technical information to implement such parameter extraction in accordance with a given arrangement of the mixing parameters (or with a given encoding scheme). In an example embodiment, the downmix stage 410 is time-invariant and/or frequency-invariant. By virtue of the time invariance and/or frequency invariance, there is no need for a communicative connection between the downmix stage 410 and the parameter extractor 420, but the parameter extraction may proceed independently. This provides great latitude for the implementation. It also gives a possibility to reduce the total latency of the system since several processing steps may be carried out in parallel. As one example, the Dolby Digital Plus format (or Enhanced AC-3) may be used for coding the downmix signal X.

The parameter extractor 420 may have knowledge of the quantitative and/or qualitative properties of the downmix stage 410 by accessing a downmix specification, which may specify one of: a set of gain values, an index identifying a predefined downmixing mode for which gains are predefined, etc. The downmix specification may be a data record pre-loaded into memories in each of the downmix stage 410 and the parameter extractor 420. Alternatively, the downmix specification may be transmitted from the downmix stage 410 to the parameter extractor 420 over a communication line connecting these units. As a further alternative, each of the downmix stage 410 to the parameter extractor 420 may access the downmix specification from a common data source, such as a memory (not shown) in the audio processing system or in a metadata stream associated with the input signal Y.

III. Equivalents, Extensions, Alternatives and Miscellaneous

Further embodiments of the present invention will become apparent to a person skilled in the art after studying the description above. Even though the present description and drawings disclose embodiments and examples, the invention is not restricted to these specific examples. Numerous modifications and variations can be made without departing from the scope of the present invention, which is defined by the accompanying claims. Any reference signs appearing in the claims are not to be understood as limiting their scope.

The systems and methods disclosed hereinabove may be implemented as software, firmware, hardware or a combination thereof. In a hardware implementation, the division of tasks between functional units referred to in the above description does not necessarily correspond to the division into physical units; to the contrary, one physical component may have multiple functionalities, and one task may be carried out by several physical components in cooperation. Certain components or all components may be implemented as software executed by a digital signal processor or microprocessor, or be implemented as hardware or as an application-specific integrated circuit. Such software may be distributed on computer readable media, which may comprise computer storage media (or non-transitory media) and communication media (or transitory media). As is well known to a person skilled in the art, the term computer storage media includes both volatile and nonvolatile, removable and non-removable media implemented in any method or technology for storage of information such as computer readable instructions, data structures, program modules or other data. Computer storage media includes, but is not limited to, RAM, ROM, EEPROM, flash memory or other memory technology, CD-ROM, digital versatile disks (DVD) or other optical disk storage, magnetic cassettes, magnetic tape, magnetic disk storage or other magnetic storage devices, or any other medium which can be used to store the desired information and which can be accessed by a computer. Further, it is well known to the skilled person that communication media typically embodies computer readable instructions, data structures, program modules or other data in a modulated data signal such as a carrier wave or other transport mechanism and includes any information delivery media.

The invention claimed is:

1. An audio processing system for performing spatial synthesis, the system comprising an upmix stage for receiving a decoded m-channel downmix signal and for outputting, based thereon, an n-channel upmix signal, wherein $2 \leq m < n$, the upmix stage comprising:

a downmix modifying processor for receiving the m-channel downmix signal and for outputting a modified m-channel downmix signal, the downmix modifying processor adapted to cross mix and process the downmix signal in a non-linear fashion; and a first mixing matrix for receiving the downmix signal and the modified downmix signal, the first mixing matrix adapted to perform a n-channel linear combination of the m-channel downmix signal and modified downmix signal only and for outputting the n-channel upmix signal, wherein:

the first mixing matrix is adapted to receive one or more mixing parameters for controlling at least one gain in the linear combination performed by the first mixing matrix:

and where the mixing parameters are in quantized format; and wherein the n-channel upmix signal comprises a set of channels that are obtained as linear combinations of both the downmix signal and the modified downmix signal; and wherein in the linear combination performed by the first mixing matrix, all gains applied in order to obtain said set of channels are polynomials of one or more of the mixing parameters, wherein the order of each polynomial is less than or equal to 2.

2. The audio processing system of claim 1, wherein:

the first mixing matrix is adapted to receive the mixing parameters in quantized format;

and wherein in the linear combination performed by the first mixing matrix, all gains applied to channels in the downmix signal are polynomials of one or more of the mixing parameters, wherein the order of each polynomial is equal to 2.

3. The audio processing system of claim 1, wherein:

the first mixing matrix is adapted to receive the mixing parameters in quantized format; and wherein all gains applied to channels in the modified downmix signal are polynomials of one or more of the mixing parameters, wherein the order of each polynomial is less than or equal to 1.

4. The audio processing system of claim 1, wherein a contribution from a channel in the downmix signal to a spatially corresponding channel in the upmix signal is individually controllable by means of a mixing parameter, and any other contributions to the same channel in the downmix signal are controllable by uniformly quantized mixing parameters.

5. The audio processing system of claim 1, wherein one of the mixing parameters encodes two gain parameters; and one or more gains in the linear combination performed by the first mixing matrix depend linearly on one of these two gain parameters.

6. The audio processing system of claim 1, wherein:

the upmix stage is arranged to operate on frequency-domain representations of downmix and upmix signals;

each signal and each mixing parameter is segmented into time frames and comprises a plurality of frequency subbands, wherein all signals share, for each time frame, a first single subband configuration, and all mixing parameters share, for each time frame, a second single subband configuration; and the second subband configuration defines frequency subbands of the mixing parameters which control the gains applied, in said linear combination performed by the first mixing matrix, to associated frequency subbands of the signals.

7. The audio processing system of claim 6, wherein all frequency subbands of at least one of the mixing parameters are quantized with respect to a uniform resolution, and optionally, wherein the uniform resolution is common to all frequency subbands of the mixing parameter.

8. The audio processing system of claim 6, further being configured to generate the upmix signal, by means of the first mixing matrix, in a qualitatively uniform fashion for all frequency subbands.

9. The audio processing system of claim 6, arranged to operate on partially complex frequency-domain representations of the downmix and upmix signal, wherein each of the partially complex frequency-domain representations comprises, in an upper frequency range: first spectral components representing spectral content of the corresponding signal expressed in a first subspace of a multidimensional space, and, in a lower frequency range: in addition to said first spectral components, second spectral components representing spectral content of the corresponding signal expressed in a second subspace of the multidimensional space that includes a portion of the multidimensional space not included in the first subspace.

10. The audio processing system of claim 9, wherein each of the partially complex frequency-domain representations is critically sampled in the upper frequency range.

11. The audio processing system of claim 1, the downmix modifying processor comprising:

a second mixing matrix for receiving the m-channel downmix signal, for forming a linear combination of the downmix signal channels and for outputting this as an m-channel intermediate signal; and a decorrelator for receiving the m-channel intermediate signal and for outputting the modified downmix signal comprising m decorrelated channels, wherein the second mixing matrix is configured to accept at least one of said one or more mixing parameters, said at least one mixing parameter controlling at least one coefficient in the linear combination performed by the second mixing matrix.

12. The audio processing system of claim 11, wherein the decorrelator comprises an artifact attenuator configured to detect sound endings in the intermediate signal and take corrective action in response thereto.

13. The audio processing system of claim 1, further comprising an audio decoder receiving a bitstream encoding the downmix signal and outputting, based thereon, the decoded m-channel downmix signal.

14. A spatial synthesis method, comprising the steps of:

modifying, in a downmix modifying processor, an m-channel downmix signal by cross mixing and non-linear processing of the downmix signal, to obtain a modified downmix signal; and forming, in a first mixing matrix, an n-channel linear combination of the downmix signal and the modified downmix signal and outputting this as an n-channel upmix signal, wherein $2 \leq m < n$, wherein:

receiving in the first mixing matrix, one or more mixing parameters to control at least one gain in the linear combination performed by the first mixing matrix and where the mixing parameters are in quantized format; wherein:

the n-channel upmix signal comprises a set of channels that are obtained as linear combinations of both the downmix signal and the modified downmix signal; and wherein in the linear combination performed by the first mixing matrix, all gains applied in order to obtain said set of channels are polynomials of one or more of the mixing parameters, wherein the order of each polynomial is less than or equal to 2.

15. An audio processing system for performing spatial analysis and spatial synthesis, the system comprising:

a spatial analysis system and a spatial synthesis system, the spatial analysis system comprising:

a downmix stage for receiving an n-channel input signal, for forming an m-channel linear combination of the channels in the n-channel signal and for outputting this as an m-channel output signal, wherein $2 \leq m < n$; and a parameter extractor for receiving the n-channel input signal and for outputting one or more mixing parameters, the mixing parameters adapted to control at least one gain in the spatial synthesis system, wherein the downmix stage and the parameter extractor operate in parallel without information exchange between the downmix stage and the parameter extractor and/or without the downmix stage and the parameter extractor being synchronized; and the spatial synthesis system, comprising:

an upmix stage for receiving the m-channel downmix signal and for outputting, based thereon, an n-channel upmix signal, wherein $2 \leq m < n$, the upmix stage comprising:

a downmix modifying processor for receiving the m-channel downmix signal and for outputting a modified downmix signal, the downmix modifying processor adapted to cross mix and process the downmix signal in a non-linear fashion; and a first mixing matrix adapted to perform a n-channel linear combination of the m-channel downmix signal and modified downmix signal and for outputting the n-channel upmix signal, wherein the first mixing matrix is adapted to receive one or more of the mixing parameters for controlling said gain in the linear combination performed by the first mixing matrix, wherein the mixing parameters are in quantized format, wherein the n-channel upmix signal comprises a set of channels that are obtained as linear combinations of both the downmix signal and the modified downmix signal; and wherein in the linear combination performed by the first mixing matrix, all gains applied in order to obtain said set of channels are polynomials of one or more of the mixing parameters, wherein the order of each polynomial is less than or equal to 2.

16. The audio processing system of claim 15, wherein the downmix stage and the parameter extractor both have access to a downmix specification quantitatively controlling the forming of said m-channel linear combination in the downmix stage.

17. The audio processing system of claim 15, wherein the downmix stage is arranged to operate on time-domain representations of the signals.

18. A computer program product comprising a non-transitory computer-readable medium with computer-readable instructions for performing the method of claim 14.

* * * * *